US005817247A

United States Patent [19]

Colatruglio

[11] Patent Number: 5,817,247

[45] Date of Patent: Oct. 6, 1998

[54] WALL SUPPORTING

[76] Inventor: Timothy Colatruglio, 617 Winter Rd., Delaware, Ohio 43015-8903

[21] Appl. No.: 777,356

[22] Filed: Dec. 27, 1996

[51] Int. Cl.[6] ..... E04G 17/14

[52] U.S. Cl. ..... 249/4; 249/2; 249/3; 249/7; 249/207; 249/210; 249/219.1

[58] Field of Search ..... 249/2, 3, 4, 7, 249/207, 210, 219.1

[56] References Cited

U.S. PATENT DOCUMENTS 5,076,536 12/1991 Fitzgerald ..... 249/219.1

*Primary Examiner*—David W. Wu

*Attorney, Agent, or Firm*—Philip M. Dunson; Philip J. Pollick

[57] ABSTRACT

A device 10 is provided for supporting a wall 11 of a form for containing concrete and like fluid materials. It comprises the following components and arrangements thereof relative to each other; and normally but not necessarily arranged as in FIG. 1 relative to the wall 11 and an underneath supporting entity 26: an upright member 12 with its front surface 13 pressing against the wall 11; a coupling member 18 attached to or integral with the back surface 19 of the upright member 12 in the vicinity of its upper end 20; a pivotable substantially flat elongate lower member 14 hingedly joined 15 at its near end 16 to the lower end 17 of the upright member 12 and held firmly in a fixed location on the upper surface of an underneath supporting entity 26; an upwardly-extending end portion 28 at the far end 29 of the lower member 14; a pivotable solid elongate force-resistant upper member 30 hingedly joined 31, at its near end 32, to the coupling member 18 and, in the vicinity of its far end 33, passing through an opening 34 in the end portion 28 of the lower member 14; and a movable holding member 35 for pressing the upper member 30 tightly enough against the end portion 28 to prevent lengthwise movement of the upper member 30, and thereby to support the form wall 11 against pressure from wet fluid material that is poured into it in the vicinity of the supporting device 10.

17 Claims, 2 Drawing Sheets

10
11
12
13
14
15
16
17
18
19
20
21
22
23
24
25
26
27
28
29
30
31
32
33
34
35
40
42
44
46
48
50
52
2
2R
2L

WALL SUPPORTING

STATEMENT AS TO RIGHTS TO INVENTIONS MADE UNDER FEDERALLY-SPONSORED RESEARCH AND DEVELOPMENT

None.

CROSS-REFERENCES TO RELATED APPLICATIONS

None.

This invention relates to devices for supporting walls such as those used in forms for holding fluid material in place within them. The devices are especially useful for bracing the substantially vertical retaining walls of forms used to contain wet concrete until it has hardened.

BACKGROUND OF INVENTION

1. Field of Invention

Where the ground, roof, floor, or other underneath supporting entity on which the wall supporting device rests may not be level, it is necessary to be able to adjust the angles in the pressure resisting members in the device so as to be able to conveniently to maintain the wall in its desired position (usually at least approximately vertical).

2. Description of the Related Art including information disclosed under 37 CFR 1.97–1.99.

The prior art includes various adjustable, as well as nonadjustable, concrete form supporting brackets.

U.S. Pat. No. 2,031,612, Masor, is typical of patents wherein the supporting structures include stakes and wedges for retaining their positions. The main supports comprise rigid right triangular members; so they cannot be adjusted to fit well on sloping terrain.

U.S. Pat. No. 3,785,606, Green, relates to a foundation mechanism comprising a base having a narrow vertically extending and horizontally elongated section and a relatively wide and horizontally elongated top section. The top section supports a foundation form that in one embodiment is flexible, for forming a curved foundation. In another embodiment the form is a channel. The form and the top section of the base are constructed to provide a series of vertically aligned guides spaced from one another to receive stakes. The form is connected with one end of each of a plurality of longitudinally extendible and contractible braces, and the other ends are held in place by stakes. Green's bracket does not include any member along the ground between the vertical parts and the stake.

U.S. Pat. No. 5,076,536, Fitzgerald, discloses a supporting bracket for a concrete form including an upright form supporting member, a lower prop leg connected to the upright member, an upper leg prop connected to the upright member at one end and a slidable member at its other end. The slidable member cooperates with the lower prop leg to slide therealong and includes a plurality of angle slots that mate with a plurality of oppositely angled slots on the lower prop leg. The angle slots are selectively fixed relative to one another by a stake that is driven into the ground.

The Slabmaker I, shown in a 1986 flyer of Medalist Forming Systems, is another adjustable support bracket of the same general type.

The present invention provides all of the functions of the above adjustable devices, and less expensively. Devices according to the present invention can also be used in an alternative manner that is particularly advantageous in some situations and is not available with the prior art devices.

SUMMARY OF INVENTION

According to the present invention a device is provided for supporting a wall of a form for containing concrete and like fluid materials, comprising the following components and arrangements thereof relative to each other; and normally but not necessarily arranged as in FIG. 1 relative to the wall and an underneath supporting entity: an upright member with its front surface pressing against the wall; a coupling member attached to or integral with the back surface of the upright member in the vicinity of its upper end; a pivotable substantially flat elongate lower member hingedly joined at its near end to the lower end of the upright member and held firmly in a fixed location on the upper surface of an underneath supporting entity; an upwardly-extending end portion at the far end of the lower member; a pivotable solid elongate force-resistant upper member hingedly joined, at its near end, to the coupling member and, in the vicinity of its far end, passing through an opening in the end portion of the lower member; and a movable holding member for pressing the upper member tightly enough against the end portion to prevent lengthwise movement of the upper member, and thereby to support the form wall against pressure from wet fluid material that is poured into it in the vicinity of the supporting device.

Where the normally-lower member is substantially longer than the normally-upright member, and holes are provided in the normally-upright member, the device can be positioned, as shown in FIG. 3, approximately perpendicular vertically to its normal position, in an alternative arrangement of the components relative to the wall and the underneath supporting entity, to hold firmly in place a taller wall than could be held as effectively with the device in its normal arrangement of the components relative to the wall and the underneath supporting entity.

Various advantages of the invention will become apparent from the following disclosure in which the currently preferred embodiments of the invention are described in detail and illustrated in the accompanying drawings. It is contemplated that variations in procedures, structural features, and arrangement of parts may appear without departing from the scope of or sacrificing the advantages of the invention.

In describing the typical embodiments of the invention illustrated in the drawings, specific terminology is used for the sake of clarity. However, it is not intended that the invention be limited to the specific terms so selected and it is to be understood that each specific term includes all technical equivalents that operate in a similar manner to accomplish a similar purpose.

Although typical preferred embodiments of the invention are described herein, it is understood that various changes and modifications in the illustrated and described structure can be effected without departure from the basic principles that underlie the invention. Changes and modifications of this type are therefore deemed to be included by the spirit and scope of the invention, except as the same may be necessarily modified by the claims or reasonable equivalents thereof.

DESCRIPTION OF THE PREFERRED EMBODIMENT(S)

Figures 1, 2:
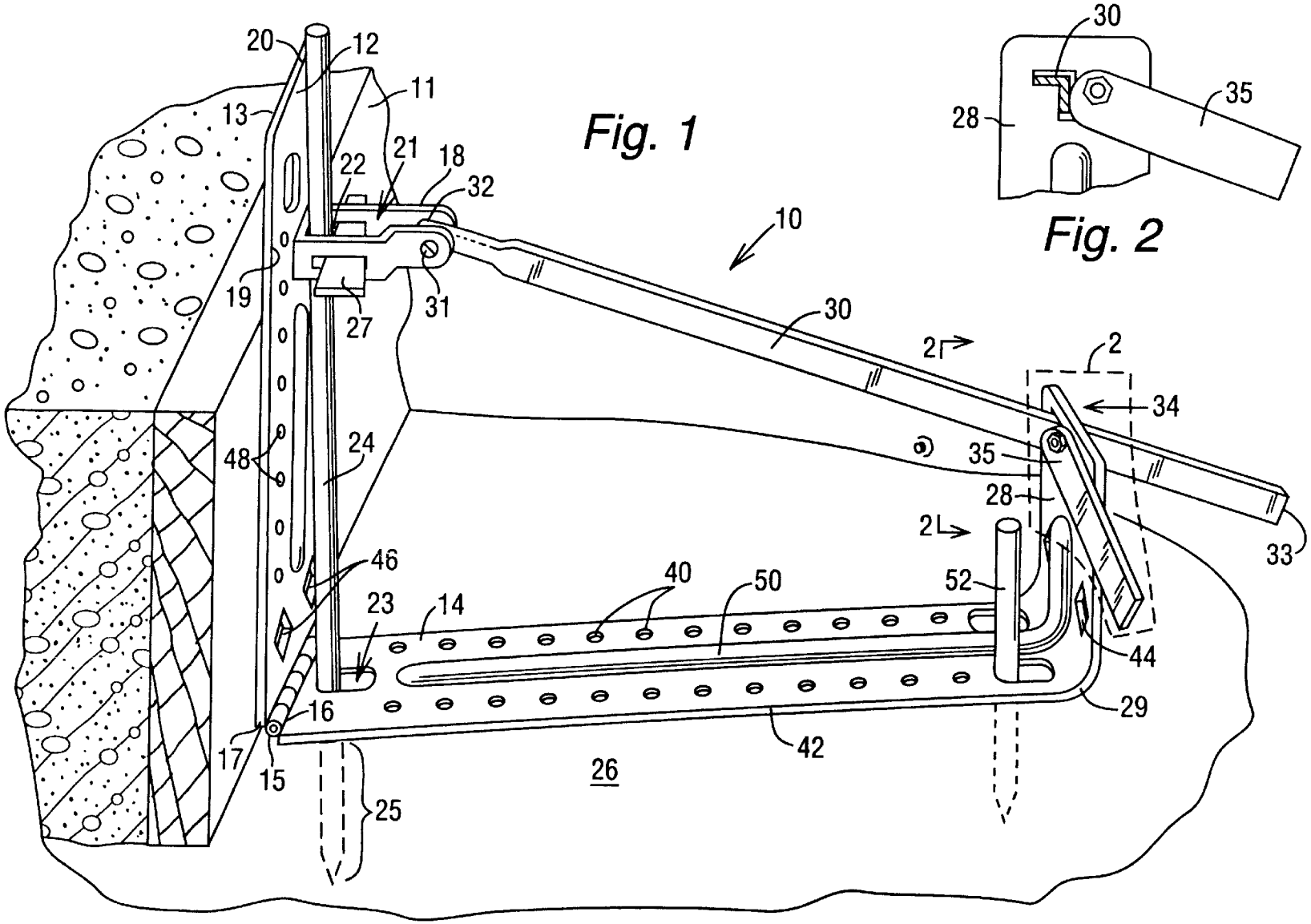
FIG. 1 is a perspective view of a typical device according to the present invention in a usual arrangement of its components relative to a supporting wall and an underneath supporting entity.
FIG. 2 is a side view, as indicated by the arrows 2—2 in FIG. 1, of the right end portion of the device in the region enclosed in the dashed line 2.

Referring now to the drawings, and primarily to FIG. 1, a typical device 10 for supporting a wall 11 of a form for containing concrete and like fluid materials, comprises the following components and arrangements thereof relative to each other; and normally but not necessarily arranged as specified herein relative to the wall 11 and an underneath supporting entity 26:

an upright member 12 with its front surface 13 pressing against the wall 11;

a coupling member 18 attached to or integral with the back surface 19 of the upright member 12 in the vicinity of its upper end 20;

a pivotable substantially flat elongate lower member 14 hingedly joined 15 at its near end 16 to the lower end 17 of the upright member 12 and held firmly in a fixed location on the upper surface of an underneath supporting entity 26;

an upwardly-extending end portion 28 at the far end 29 of the lower member 14; and a pivotable solid elongate force-resistant upper member 30 hingedly joined 31, at its near end 32, to the coupling member 18 and, in the vicinity of its far end 33, passing through an opening 34 in the end portion 28 of the lower member 14; and a movable holding member 35 for pressing the upper member 30 tightly enough against the end portion 28 to prevent lengthwise movement of the upper member 30, and thereby to support the form wall 11 against pressure from wet fluid material that is poured into it in the vicinity of the supporting device 10.

Typically the upper member 30 is of such length, and the opening 34 in the end portion 28 of the lower member 14 is of such size and shape, that the upper member 30 can pass through the opening 34 as long as the lower member 14 is in a position within about twenty degrees of the horizontal. The members may also have such length, size, and shape as to be conveniently usable on steeper slopes. The lower member 14 typically has, approximately midway between and parallel to its sides, an upwardly-bent riblike lengthwise region 50 for strengthening it, especially in the vicinity of the upwardly-extending end portion 28.

In a typical supporting device according to the invention the coupling member 18 has a vertical opening 21 therethrough and an adjacent substantially horizontal opening 22 therethrough;

the lower member 14 has a vertical opening 23 therethrough directly below at least a portion of the vertical opening 21 in the coupling member 18;

and the device 10 comprises also an optional elongate bar 24 that passes vertically through the vertical opening 21 in the coupling member 18 and the vertical opening 23 in the lower member 14 and is driven a substantial distance 25 into the supporting entity 26 on which the lower member 14 is located;

the vertical opening 23 in the lower member 14 being of such size and shape that the bar 24 can pass through it vertically as long as the lower member 14 is in a position within about twenty degrees of the horizontal; and a movable holding member 27 for pressing against the bar 24 to hold it tightly in place within the coupling member 18 after the bar 24 has been driven into the supporting entity 26 to the desired substantial distance 25.

Typically the holding member 27 associated with the coupling member 18 comprises a horizontally movable substantially wedge-shaped member 27 that passes through the substantially horizontal opening 22 in the coupling member 18. The holding member associated with the end portion 28 of the lower member 14 typically comprises a cammed lever 35.

Holes 40 may be provided in the lower member 14 through which nails, spikes, or the like can be pounded into the supporting entity 26 (or through any penetrable material present between the lower member 14 and the supporting entity 26, and into the supporting entity 26) to hold the lower member 14 tightly in place thereon. It is to be realized that various combinations of the elongate bar 24, fasteners used with holes 40, and bar 52 may be used to fasten and secure device 10 to the supporting entity 26.

Figure 3:
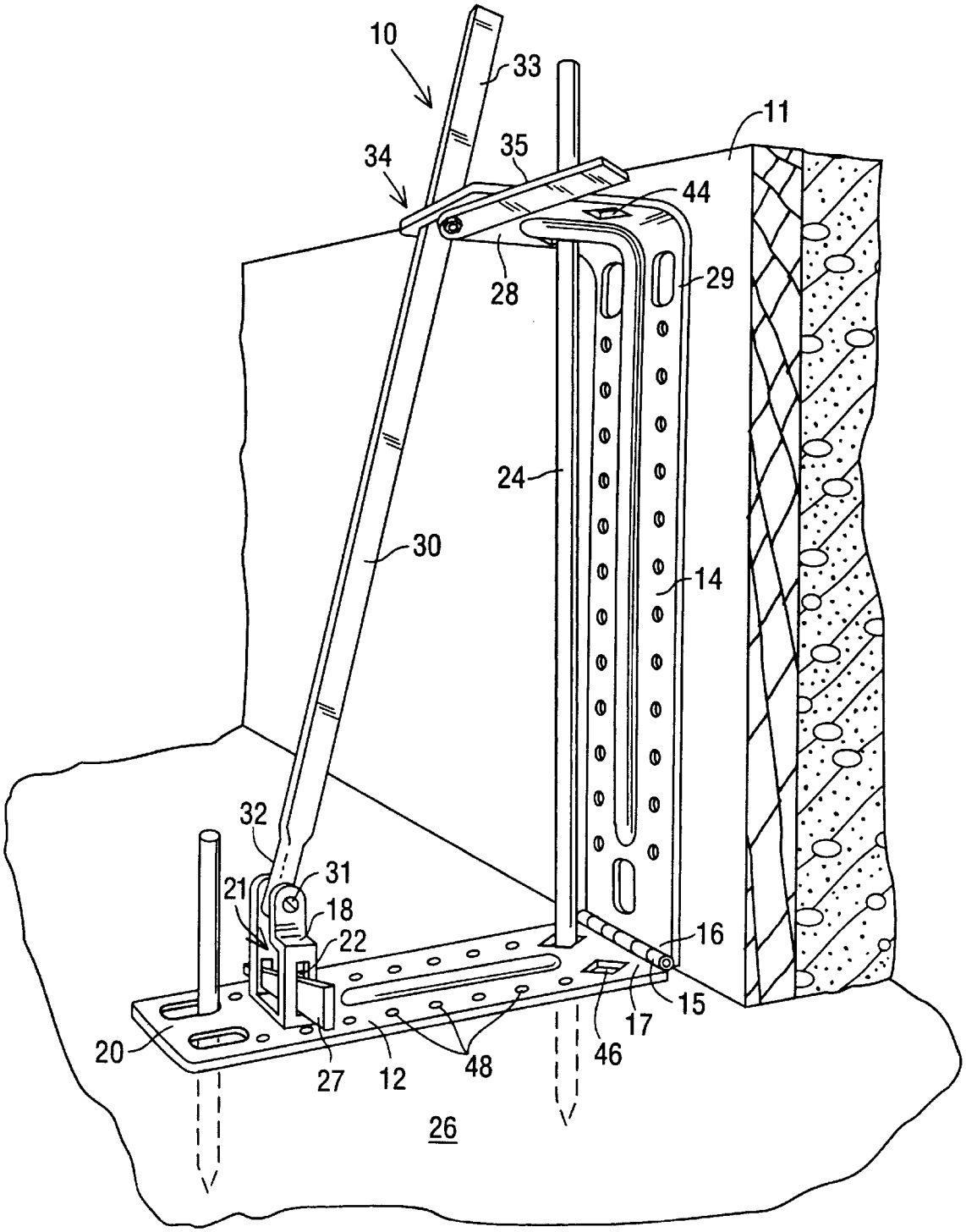
FIG. 3 is a perspective view of a device as in FIG. 1 in an alternative arrangement of the components relative to the supporting wall and the underneath supporting entity.

Referring now largely to FIG. 3, the normally-lower member 14 typically is substantially longer than the normally-upright member 12, and typically holes 48 are provided in the normally-upright member 12, so that the device 10 can be positioned in an alternative arrangement of the components relative to the wall 11 and the underneath supporting entity 26, with the device 10 positioned approximately perpendicular vertically to its normal position; and the normally uprightly-positioned member 12 can be positioned with its normally front surface 13 resting on, and held firmly on, the upper surface of the underneath supporting entity 26 in a fixed location corresponding to the normal location of the normally lower-positioned member 14;

the normally lower-positioned member 14 can be positioned upright with its normally underneath surface 42 pressing against the wall 11; and the elongate force-resistant upper member 30 supports the concrete form wall 11 against pressure from wet fluid material that is poured into it in like manner to the supporting provided by the device 10 when positioned in its normal arrangement relative to the wall 11 and the underneath supporting entity 26;

said alternative arrangement thereby enabling the device 10 to hold firmly in place a taller wall 11 than could be held as effectively with the device 10 in its normal arrangement of the components relative to the wall 11 and the underneath supporting entity 26.

A typical device comprising the components and arrangement thereof relative to each other as in FIG. 1, but in the alternative arrangement of the components relative to the wall 11 and the underneath supporting entity 26 as described in the last preceding paragraph and as illustrated in FIG. 3, then has the normally uprightly-positioned member 12 positioned with its normally front surface 13 resting on and held firmly on the upper surface of the underneath supporting entity 26 in a fixed location corresponding to the normal location of the normally lower-positioned member 14;

the normally lower-positioned member 14 being substantially longer than the normally uprightly positioned member 12, and being positioned upright with its normally underneath surface 42 pressing against the wall 11; and the elongate force-resistant upper member 30 thus supporting the concrete form wall 11 against pressure from wet fluid material that is poured into it in like manner to the supporting provided by the device 10 when positioned in its normal arrangement relative to the wall 11 and the underneath supporting entity 26;

said alternative arrangement thereby enabling the device 10 to hold firmly in place a taller wall 11 than could be held as effectively with the device 10 in its normal arrangement of the components relative to the wall 11 and the underneath supporting entity 26. Typically holes 48 are provided in the now lower-positioned member 12 through which (holes 48) nails, spikes, or the like can be pounded into the supporting entity 26 to hold the now lower-positioned member 12 tightly in place thereon. Typically also an upper opening 44 is provided through the end portion 28 of the normally lower-positioned (and now uprightly-positioned) member 14; said end portion 28 in its present alternative arrangement being in a plane substantially perpendicular to the wall 11, above, and substantially spaced apart from, the underneath supporting entity 26; a lower opening 46 is provided through the normally uprightly-positioned member 12 (and now resting on the underneath supporting entity 26) directly below the upper opening 44; and an elongate bar 24 passes through the upper opening 44 and the lower opening 46 and is driven a substantial distance into the underneath supporting entity 26 on which the normally uprightly-positioned member 12 rests in the present alternative arrangement.

To recapitulate, this invention is a support for a cement-based fluid form having a first member 12 with a first end portion 20, a second, opposite end, 17 and a second member 14 with a first end 16 and a second end portion 28 extending at substantially a right angle to the remaining portion of second member 14. The second end 17 of the first member is pivotally joined to the first end 16 of the second member 14. A third member 30 has a first end portion 32 and a second end portion 33. A coupling 18 is attached to or formed as an integral tab, tang, flange, or other securing point in the end portion 20 of the first member 12. Preferably first end 32 is pivotally attached to the coupling 18 although other securing devices such as a cammed lever or wedge can be used to force the third member tightly against the side of a receiving aperture in the coupling. The second end portion 33 of third member 30 is secured to the second end portion 28 with a wedge, cammed lever, rachet or other securing mechanism. Preferably the first end 32 of third member 30 is pivotally joined to coupling 18 while the second end 33 passes through an aperture 34 in end portion 28 of the second member and is forced tightly against end portion 28 with a cammed lever 35. Apertures 23, 40, 44, 47, 48 can receive various securing devices including pins, bars (stakes) 24 and 52, nails and the like for further securing the device to its supporting entity 26. A bar such as stake 24 can be further secured to coupling 18 by means of a securing device such as a wedge 27.

While the forms of the invention herein disclosed constitute currently preferred embodiments, many others are possible. It is not intended herein to mention all of the possible equivalent forms or ramifications of the invention. It is to be understood that the terms used herein are merely descriptive rather than limiting, and that various changes may be made without departing from the spirit or scope of the invention.

It is possible that changes in configurations to other than those shown could be used, but what is shown is currently preferred and typical. Without departing from the spirit of this invention, various means of fastening the components together may be used.

It is therefore understood that although the present invention has been specifically disclosed with preferred embodiments and examples, modifications to the design concerning sizing and shape will be apparent, and such modifications and variations are considered to be equivalent to, and within the scope of, the disclosed invention and the claims.

I claim:

1. A device for supporting a wall of a form for containing concrete and like fluid materials, comprising the following components and arrangements thereof relative to each other; and normally arranged as specified herein relative to the wall and an underneath supporting entity:

an upright member with its front surface pressing against the wall;

a coupling member attached to or integral with the back surface of the upright member in the vicinity of its upper end;

a pivotable substantially flat elongate lower member hingedly joined at one end to the lower end of the upright member, extending away from the back surface of the upright member, and held firmly in a fixed location on the upper surface of the underneath supporting entity;

an upwardly-extending end portion at the other end of the lower member;

a pivotable solid elongate force-resistant upper member hingedly joined, at one end, to the coupling member and, in the vicinity of its end, passing through an opening in the upwardly-extending end portion of the lower member;

a movable holding member for pressing the upper member tightly enough against the end portion to prevent lengthwise movement of the upper member, and thereby to support the form wall against pressure from wet fluid material that is poured into it in the vicinity of the supporting device.

2. A device as in claim 1, wherein the upper member is of such length and the opening in the end portion of the lower member is of such size and shape that the upper member can pass through the opening as long as the lower member is in a position within about twenty degrees of the horizontal.

3. A device as in claim 1, wherein the lower member has, approximately midway between and parallel to its sides, an upwardly-bent riblike lengthwise region 50 for strengthening it, especially in the vicinity of the upwardly-extending end portion.

4. A device as in claim 1, wherein the coupling member has a vertical opening therethrough and an adjacent substantially horizontal opening therethrough;

the lower member has a vertical opening therethrough directly below at least a portion of the vertical opening in the coupling member;

and the device comprises also:

an elongate bar that passes vertically through the vertical opening in the coupling member and the vertical opening in the lower member and is driven a substantial distance into the supporting entity on which the lower member is located;

the vertical opening in the lower member being of such size and shape that the bar can pass through it vertically as long as the lower member is in a position within about twenty degrees of the horizontal;

a movable holding member for pressing against the bar to hold it tightly in place within the coupling member after the bar has been driven into the supporting entity to the desired substantial distance.

5. A device as in claim 4, wherein the holding member associated with the coupling member comprises a horizontally movable substantially wedge-shaped member that passes through the substantially horizontal opening in the coupling member.

6. A device as in claim 1, wherein the holding member associated with the end portion of the lower member comprises a cammed lever.

7. A device as in claim 1, wherein holes are provided in the lower member through which nails, spikes, or the like can be pounded into the supporting entity to hold the lower member tightly in place thereon.

8. A device as in claim 1, wherein holes are provided in the lower member through which nails, spikes, or the like can be pounded through any penetrable material present between the lower member and the supporting entity, and into the supporting entity, to hold the lower member tightly in place thereon.

9. A device as in claim 1, wherein the normally-lower member is substantially longer than the normally-upright member, and holes are provided in the normally-upright member, so that the device can be positioned in an alternative arrangement of the components relative to the wall and the underneath supporting entity, with the device positioned approximately perpendicular vertically to its normal position; and wherein the normally uprightly-positioned member is positioned with its normally front surface resting on and held firmly on the upper surface of the underneath supporting entity in a fixed location corresponding to the normal location of the normally lower-positioned member;

the normally lower-positioned member is positioned upright with its normally underneath surface pressing against the wall; and the elongate force-resistant upper member supports the concrete form wall against pressure from wet fluid material that is poured into it in like manner to the supporting provided by the device when positioned in its normal arrangement relative to the wall and the underneath supporting entity;

said alternative arrangement thereby enabling the device to hold firmly in place a taller wall than could be held as effectively with the device in its normal arrangement of the components relative to the wall and the underneath supporting entity.

10. A device comprising the components and arrangement thereof relative to each other as in claim 1, in the following alternative arrangement of the components relative to the wall and the underneath supporting entity:

the normally uprightly-positioned member being positioned with its normally front surface resting on and held firmly on the upper surface of the underneath supporting entity in a fixed location corresponding to the normal location of the normally lower-positioned member;

the normally lower-positioned member being substantially longer than the normally uprightly positioned member, and being positioned upright with its normally underneath surface pressing against the wall; and the elongate force-resistant upper member thus supporting the concrete form wall against pressure from wet fluid material that is poured into it in like manner to the supporting provided by the device when positioned in its normal arrangement relative to the wall and the underneath supporting entity;

said alternative arrangement thereby enabling the device to hold firmly in place a taller wall than could be held as effectively with the device in its normal arrangement of the components relative to the wall and the underneath supporting entity.

11. A device as in claim 10, wherein holes are provided in the now lower-positioned member through which holes nails, spikes, or the like can be pounded into the supporting entity to hold the now lower-positioned member tightly in place thereon.

12. A device as in claim 10, wherein an upper opening is provided through the end portion of the normally lower-positioned (and now uprightly-positioned) member;

said end portion in its present alternative arrangement being in a plane substantially perpendicular to the wall, above, and substantially spaced apart from, the underneath supporting entity;

a lower opening is provided through the normally uprightly-positioned member (and now resting on the underneath supporting entity) directly below the upper opening; and an elongate bar passes through the upper opening and the lower opening and is driven a substantial distance into the underneath supporting entity on which the normally uprightly-positioned member rests in the present alternative arrangement.

13. A support for a fluid form comprising a first member with a first end portion and a second, opposite end; a second member with a first end and a second opposite end portion extending at substantially a right angle to the remaining portion of said second member; said first member being pivotally joined at its second end to said first end of said second member; a third member having a first end portion and a second end portion; means for securing said first end portion of said third member to said first end portion of said first member; and means for securing said second end portion of said third member to said second end portion of said second member.

14. The support as in claim 13 with said first member and said second member having one or more apertures formed therein.

15. The support as in claim 14 having one or more securing devices passing through said apertures.

16. The support as in claim 15 wherein at least one of said securing devices is secured to said means for securing said first end portion of said third member to said first end portion of said first member.

17. A support as in claim 15 wherein at least one of said stakes passes through an aperture near said second end of said first member and an aperture in said second end portion of said second member extending at substantially a right angle to said remaining portion of said second member.

* * * * *